US009757745B2

(12) United States Patent
Takahashi

(10) Patent No.: US 9,757,745 B2
(45) Date of Patent: Sep. 12, 2017

(54) MATRIX FILM DEPOSITION SYSTEM

(71) Applicant: Shimadzu Corporation, Kyoto-shi, Kyoto (JP)

(72) Inventor: Kazuteru Takahashi, Kyoto (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 15 days.

(21) Appl. No.: 14/798,691

(22) Filed: Jul. 14, 2015

(65) Prior Publication Data

US 2016/0167065 A1 Jun. 16, 2016

(30) Foreign Application Priority Data

Dec. 12, 2014 (JP) ..... 2014-251620

(51) Int. Cl.

| | |
|---|---|
| ***B05B 5/08*** | (2006.01) |
| ***B05B 5/00*** | (2006.01) |
| ***B05B 5/03*** | (2006.01) |
| ***B05D 1/04*** | (2006.01) |
| ***B05B 5/053*** | (2006.01) |
| *B05B 5/16* | (2006.01) |

(Continued)

(52) U.S. Cl.

CPC ..... *B05B 5/087* (2013.01); *B05B 5/005* (2013.01); *B05B 5/03* (2013.01); *B05B 5/0535* (2013.01); *B05B 5/1608* (2013.01); *B05D 1/04* (2013.01); *B05B 5/16* (2013.01); *B05C 5/02* (2013.01); *B05C 5/0208* (2013.01); *H01J 49/0418* (2013.01); *H01J 49/164* (2013.01)

(58) Field of Classification Search

CPC B05B 5/087; B05B 5/03; B05B 5/005; B05B 5/16; B05B 5/1608; B05B 5/0535; B41J 2/06; B41J 2/095; B41J 2/085; B41J 2/035; B05D 1/04; H01J 49/04218; H01J 49/164; B05C 5/02; B05C 5/0208

USPC ..... 118/50.1, 620, 621, 623, 624, 625, 627, 118/629; 239/690, 704, 708

See application file for complete search history.

(56) References Cited

U.S. PATENT DOCUMENTS 3,369,252 A * 2/1968 Adams ..... B41J 2/035 347/55

7,938,516 B2 * 5/2011 Piatt ..... B41J 2/115 347/73

(Continued)

FOREIGN PATENT DOCUMENTS

JP 2013-137294 A 7/2013

*Primary Examiner* — Laura Edwards

(74) *Attorney, Agent, or Firm* — Westerman, Hattori, Daniels & Adrian, LLP

(57) ABSTRACT

A system capable of depositing a matrix film containing a low amount of impurities (e.g. neutral particles) is provided. The system includes: a first plate electrode 120 having an attachment surface on which a sample plate P is to be attached; a second plate electrode 130 arranged so as to face the attachment surface; a nozzle 110 for spraying a liquid containing a matrix substance into the space between the two electrodes 120 and 130 by an electrospray method, the nozzle 110 arranged so that none of the electrodes 120 and 130 lies on the central axis A of a spray flow of the liquid; and an electric field creator 140 for creating, between the two electrodes 120 and 130, an electric field for forcing electrically charged droplets contained in the spray flow of the liquid containing the matrix substance to move toward the attachment surface.

2 Claims, 5 Drawing Sheets

(51) Int. Cl.

| | |
|---|---|
| *B05C 5/02* | (2006.01) |
| *H01J 49/16* | (2006.01) |
| *H01J 49/04* | (2006.01) |

(56) References Cited

U.S. PATENT DOCUMENTS

| | | | | |
|---|---|---|---|---|
| 2010/0068406 | A1* | 3/2010 | Man | B05D 1/60 427/469 |
| 2013/0078387 | A1* | 3/2013 | Kauppinen | B05B 5/03 427/475 |
| 2013/0164452 | A1* | 6/2013 | Rajala | C03C 17/002 427/472 |
| 2013/0171349 | A1 | 7/2013 | Takahashi et al. | |

* cited by examiner

MATRIX FILM DEPOSITION SYSTEM

TECHNICAL FIELD

The present invention relates to a matrix film deposition system for depositing a film of a matrix substance on a sample plate which is to be used in an analysis of a sample performed with a mass spectrometer having an ion source using a matrix assisted laser desorption/ionization (MALDI) method (MALDI-MS).

BACKGROUND ART

MALDI is an ionization technique suitable for an analysis of a sample which barely absorbs laser light or one which is easily damaged by laser light (such as proteins). In this technique, a "matrix", i.e. a substance which easily absorbs laser light and which is easily ionized, is previously mixed in the sample and the obtained mixture is irradiated with laser light to ionize the sample. Normally, the matrix initially added to a sample is in a liquid form, and this matrix incorporates the target substance of the analysis (analyte) contained in the sample. Subsequently, the matrix is dried to obtain crystalline grains containing the analyte. Then, those grains are irradiated with laser light, whereby the analyte are ionized due to interaction among the analyte, matrix and laser light. In recent years, MALDI has been widely applied in the areas of bioscience and others since it enables an analysis of polymer compounds having high molecular weights without significantly fragmenting them, and furthermore, since it is suitable for microanalysis.

With a mass spectrometric method using MALDI, for example, an image showing the intensity distribution of an ion having a certain mass-to-charge ratio on a sample (mass spectrometric image) can be obtained by sufficiently reducing the spot size of the irradiating laser light and changing the relative position of the irradiation point on the sample. Such a system is known as a "mass spectrometric microscope" or "imaging mass microscope", and is expected to be particularly applied in biochemical, medical and other technical fields in order to obtain information on the distribution of proteins contained in biological cells.

In the case of obtaining a mass spectrometric image using MALDI (i.e. in the case of performing the two-dimensional mass spectrometric imaging), a sample (e.g. a slice of biological tissue) is put on a sample plate for use with a MALDI-MS, and subsequently, a matrix film is formed on the sample plate. This matrix should preferably be put on the sample plate as evenly as possible. Conventional methods for applying the matrix include spraying, dropping or depositing the matrix in a liquid form onto the sample plate.

CITATION LIST

Patent Literature

Patent Literature 1: JP 2013-137294 A

SUMMARY OF INVENTION

Technical Problem

The method which uses spraying or dropping has the problem that the matrix which has adhered to the sample plate forms comparatively large drops, and therefore, is difficult to form micro-sized crystalline grains on the sample plate, so that the spatial resolution of the two-dimensional mass spectrometric imaging is rather low. By contrast, the method which uses the deposition can form a matrix film made of micro-sized crystalline grains (for example, see Patent Literature 1). However, during the deposition process, the matrix must be heated to high temperatures and may be thermally decomposed depending on the kind of matrix substance. Furthermore, the sample plate must be placed under high vacuum during the deposition process. Therefore, every time a sample is prepared, the deposition chamber needs to be evacuated, which requires a considerable amount of time and labor.

To avoid these problems, a technique which uses the electrospray deposition (ESD) method to form a matrix film has been proposed, in which the matrix substance is applied to the sample plate using an electrospray device which can electrically charge a liquid material and spray it in the form of droplets.

FIG. 9 is a schematic configuration diagram of a matrix film deposition system using the ESI) method. This system includes a horizontal plate placement stage 420 having a top surface on which a sample plate P is to be placed, and a nozzle 410 located over the plate placement stage 420 with its tip directed downward. The nozzle 410 has a thin tube (capillary) 411 and a nebulizer gas tube 412 which is arranged coaxially with the capillary 411 in such a manner as to serve as the external cylinder surrounding the capillary 411. A high DC voltage of approximately a few kV to several tens of kV is applied from a voltage supplier 415 to either the capillary 411 or a metal cylinder (not shown) surrounding the capillary 411. Due to the influence of the electric field created by this voltage, the matrix liquid (a solution of matrix substance dissolved in a solvent) flowing through the capillary 411 becomes positively or negatively charged. With the aid of the nebulizer gas (normally, $N_2$ gas) jetted from the nebulizer gas tube 412, the matrix liquid is broken into electrically charged droplets and ejected from the nozzle 410. The ejected droplets are split into even smaller sizes by the Coulomb repulsive force of the electric charges. The flow of droplets ejected from the capillary 411 (spray flow) roughly forms a conical shape spreading in the direction of the central axis of the plate placement stage 420. Those droplets eventually adhere to the top surface of the sample plate P located under the nozzle 410. A sample (e.g. a thin slice of biological tissue) is previously put on the top surface of the sample plate P, and the analyte contained in this sample is incorporated into the matrix liquid as a result of the previously described deposition process. Then, the solvent in the matrix liquid is removed by a drying process. As a result, a matrix film made of crystalline grains containing the analyte is obtained on the sample plate P.

The ESD method is not only similar to the normal deposition method in that a matrix film made of micro-sized crystalline grains can be formed, but is also advantageous in that the matrix film can be easily and quickly formed on the sample plate since there is no need to heat the matrix to high temperatures and no high vacuum is needed during the deposition process.

However, in the conventional film deposition by the ESD method, not only the electrically charged matrix liquid but also neutral particles or other impurities contained in the spray flow also adhere to the sample plate. Therefore, in some cases, it is difficult to form a high-purity matrix film.

The present invention has been developed in view of the previously described point. Its objective is to provide a matrix film deposition system capable of depositing a matrix film which is made of micro-sized crystalline grains and which contains a low amount of impurities (e.g. neutral particles).

Solution to Problem

The matrix film deposition system according to the present invention aimed at solving the previously described problem is a system for depositing a film containing a matrix substance on a surface of a sample plate, the system including:

a) a first plate electrode having an attachment surface on which the sample plate is to be attached;

b) a second plate electrode arranged so as to face the attachment surface;

c) a nozzle for spraying a liquid containing a matrix substance into the space between the first plate electrode and the second plate electrode by an electrospray method, the nozzle arranged so that neither the first plate electrode nor the second plate electrode lies on the central axis of a spray flow of the liquid; and d) an electric field creator for creating, between the first plate electrode and the second plate electrode, an electric field for forcing electrically charged droplets of the liquid containing the matrix substance contained in the spray flow to move toward the attachment surface.

As just described, in the matrix film deposition system according to the present invention, the nozzle and the two (first and second) plate electrodes are arranged so that, when the liquid containing the matrix substance (matrix liquid) is sprayed from the nozzle by an electrospray method, the central axis of the spray flow passes through the space between the two plate electrodes and does not intersect with any of these plate electrodes. The electric field created by the electric field creator has the effect of forcing the electrically charged droplets of the matrix liquid passing through the space between the two plate electrodes to move in the direction from the second electrode to the first plate electrode and be eventually deposited on the sample plate attached to the first plate electrode. In this process, only the electrically charged droplets of the matrix liquid are attracted toward the first electrode; neutral particles without any electric charges will not be attracted toward the first plate electrode but directly pass through the space between the two plate electrodes. Thus, the deposition of the neutral particles contained in the spray flow is prevented and a matrix film containing a low amount of impurities is obtained.

In the present invention, the requirement that the second plate electrode be "arranged so as to face" the attachment surface does not always literally mean that these two elements should directly face each other. For example, the second plate electrode may be inclined from the attachment surface. In this case, the angle made by the attachment surface with the second plate electrode should preferably be 30 degrees or less, and more preferably, 10 degrees or less.

Furthermore, the second plate electrode does not need to have its central point located on the normal to the attachment surface at the central point of this surface.

That is to say, the minimal requirement is that the first and second plate electrodes be arranged so that, when DC voltage is applied between them, an electric field which forces the electrically charged droplets in the spray flow to move in a direction intersecting the central axis of the spray flow is created in the space between the attachment surface of the first plate electrode and the surface of the second plate electrode facing the spray flow.

In one mode of the matrix film deposition system according to the present invention, the nozzle includes:

e) a capillary having a tubular shape for allowing the liquid containing the matrix substance to flow from the proximal end to a droplet-spraying hole formed at the distal end; and f) a nebulizer gas ejection passage extending in parallel with the capillary, for ejecting a nebulizer gas into a region near the droplet-spraying hole, and the system further includes:

g) a voltage supplier for applying DC voltage to the capillary.

According to this configuration, the matrix liquid inside the capillary is electrically charged due to the effect of the electric field created at the tip of the capillary by the voltage applied from the voltage supplier. This electrically charged matrix liquid is sheared by the nebulizer gas and sprayed from the droplet-spraying hole.

A possible example of the matrix film deposition system having such a configuration is a system in which the nozzle is constructed as a double-tube structure including the capillary as the inner tube and the nebulizer gas tube as the outer tube. In this case, the space between the outer circumferential surface of the capillary and the inner circumferential surface of the nebulizer gas tube functions as the nebulizer gas ejection passage.

In another mode of the matrix film deposition system according to the present invention, the nozzle includes:

h) a capillary having a tubular shape for allowing the liquid containing the matrix substance to flow from the proximal end to a droplet-spraying hole formed at the distal end, and the system further includes:

i) a facing electrode located at a position facing the tip of the nozzle; and j) a voltage supplier for applying DC voltage between the capillary and the facing electrode.

The matrix film deposition system according to this mode of the present invention is configured to spray electrically charged droplets by the so-called "nano-electrospray" process. According to this configuration, a strong electric field is created in a region near the droplet-spraying hole by producing a considerable potential difference between the capillary and the facing electrode by the voltage supplier. Due to this electric field, the liquid containing the matrix substance is electrically charged and separated into positive and negative ions. Then, ions having a polarity to be attracted toward the facing electrode (i.e. the ions derived from the matrix substance), in the form of solute ions contained in the liquid, are extracted from the nozzle and sprayed.

The spray flow has a higher flow velocity and smaller spread area when it is closer to the nozzle. Therefore, if the electric field created by the electric field creator is comparatively weak, the droplets containing the matrix substance will not begin to move toward the attachment surface of the first plate electrode until they reach considerable distances from the nozzle. Consequently, the adhesion of the droplets may possibly be uneven, with a greater amount of droplets present on the central area of the sample plate and/or a more distant area from the nozzle. Conversely, if the electric field is comparatively strong, the droplets containing the matrix substance in the spray flow will be promptly attracted toward the first plate electrode, with the possible result that a greater amount of droplets adhere to an area closer to the nozzle on the sample plate.

To overcome this problem, the matrix film deposition system according to the present invention should preferably include:

k) a field strength difference creator for varying the strength of the electric field on the central axis of the spray flow according to the distance from the tip of the nozzle.

According to this configuration, the magnitude of the force for attracting the electrically charged droplets containing the matrix substance toward the first plate electrode in the space between the two plate electrodes can be varied according to the distance from the nozzle. With this system, it is possible to prevent the film thickness from being uneven due to a greater amount of droplets adhered to specific regions on the sample plate. Thus, a matrix film with an even thickness can be formed.

Additionally, the matrix film deposition system according to the present invention should preferably include:

l) a droplet size regulator for regulating the size of the droplets of the liquid containing the matrix substance to be adhered to the sample plate, by changing the potential difference between the first plate electrode and the second plate electrode.

Advantageous Effects of the Invention

As described thus far, the matrix film deposition system according to the present invention having the previously described configuration can prevent neutral particles from being deposited on the sample plate, so that a matrix film with a low content of impurities can be formed.

DESCRIPTION OF EMBODIMENTS

First Embodiment

Figure 1:
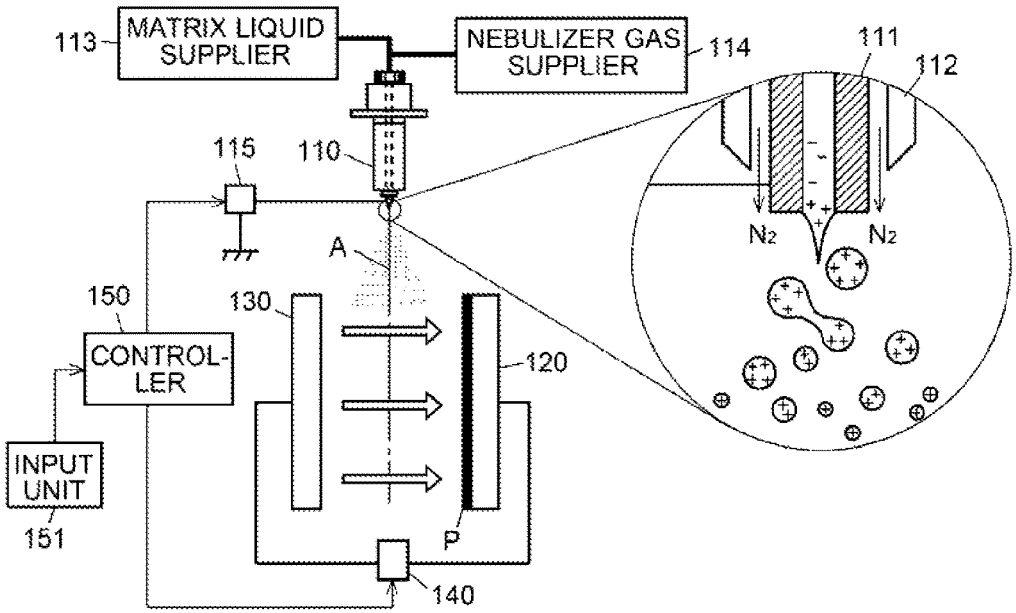
FIG. 1 is a schematic configuration diagram of a matrix film deposition system according to the first embodiment of the present invention.

FIG. 1 is a configuration diagram showing the main section of a matrix film deposition system according to one embodiment of the present invention. This matrix film deposition system includes a nozzle 110 for spraying a liquid containing a matrix substance (matrix liquid), a first plate electrode 120 on which a sample plate P is to be attached, and a second plate electrode 130 arranged so as to face the first plate electrode 120.

The area surrounded by the circle in the right area of FIG. 1 is an enlarged view of a longitudinal section of the tip portion of the nozzle 110. As shown, the nozzle 110 is a double-tube structure having a capillary 111 and a nebulizer gas tube 112 which is coaxial with the capillary 111 and which is arranged so as to serve as the external cylinder surrounding the capillary 111. The capillary 111 is supplied with a matrix liquid from a matrix liquid supplier 113. Meanwhile, inert gas (normally, nitrogen gas) which acts as a nebulizer gas is supplied from a nebulizer gas supplier 114 into the space between the outer circumferential surface of the capillary 111 and the inner circumferential surface of the nebulizer gas tube 112. A high DC voltage of a few kV to several tens of kV is applied from a spray voltage supplier 115 to either the capillary 111 itself or a metal cylinder (not shown) surrounding the capillary 111.

The first and second plate electrodes 120 and 130 are flat metal plates arranged parallel to each other with a gap of approximately 15 to 30 mm. A DC voltage of approximately ±1 kV to ±3 kV is applied between the two electrodes by a deposition voltage supplier 140 (which corresponds to the electric field creator in the present invention). A sample plate P, which is normally made of an electrically conductive material, is attached to the surface of the first plate electrode 120 facing the second plate electrode 130 (plate attachment surface). For example, the sample plate P may be a plate shaped like a slide glass which approximately measures 26 mm×76 mm or a MALDI plate with the one-side length of approximately 80 mm to 130 mm. The plate attachment surface is provided with a claw-shaped holding member made of an insulator or similar material. With this holding member, the sample plate P with a sample (e.g. a slice of biological tissue) previously put on its surface is fixed on the first plate electrode 120.

The spray voltage supplier 115 and the deposition voltage supplier 140 operate under the command of a controller 150, which consists of a computer and other devices. An input unit 151 composed of buttons, dials, keyboards or other elements for allowing users to enter commands is connected to the controller 150.

In the matrix film deposition system of the present embodiment, the nozzle 110 is positioned so that its tip is directed downward. The first and second plate electrodes 120 and 130 are located below the nozzle 110 and arranged parallel to each other as well as facing each other across the central axis A of the spray flow produced by the nozzle 110.

In the film deposition process by the matrix film deposition system of the present embodiment, when the matrix liquid supplied from the matrix liquid supplier 113 reaches the tip of the capillary 111, the liquid becomes either positively or negatively charged (in the present example, positively) due to the influence of the electric field created by the voltage applied from the spray voltage supplier 115. The matrix liquid thus electrically charged are broken into droplets and ejected with the aid of the nebulizer gas jetted from the tip of the nebulizer gas tube 112. The ejected droplets are split into even smaller sizes by the Coulomb repulsive force of the electric charges. Thus, the matrix liquid is sprayed from the tip of the nozzle 110 downward. This spray flow, spreading in a roughly conical form, enters the space between the first and second plate electrodes 120 and 130. Meanwhile, DC voltage is applied between the first and second plate electrodes 120 and 130 by the deposition voltage supplier 140, with the first plate electrode 120 acting as the cathode. Therefore, the positively charged droplets of the matrix liquid which have entered the space are attracted toward the first plate electrode 120 due to the effect of the electric field created by this voltage application, and deviate from the spray flow, to eventually adhere to the surface of the sample plate P. By contrast, neutral particles without any electric charges are not attracted toward the first plate electrode 120; they are carried by the spray flow, travel downward and directly pass through the space. Therefore, the neutral particles will not adhere to the sample plate P.

Thus, in the matrix film deposition system according to the present embodiment, only the electrically charged droplets of the matrix liquid are deposited on the sample plate P, so that a matrix film containing a lower amount of impurities than conventional films will be formed. Furthermore, according to a command entered by the user through the input unit 151, the controller 150 can change the magnitude of the voltage applied from the deposition voltage supplier 140 so as to limit the maximum size of the droplets of the matrix liquid to be adhered to the sample plate P (in this case, the controller 150 corresponds to the droplet size regulator in the present invention). More specifically, decreasing the magnitude of the voltage applied from the deposition voltage supplier 140 results in a smaller maximum size of the droplets of the matrix liquid to be adhered to the sample plate P.

In the previously described example, the electric field created by voltage application from the deposition voltage supplier 140 has an approximately uniform strength along the central axis A of the spray flow within the space between the first and second plate electrodes 120 and 130. However, the present invention is not limited to this form. For example, the electric field may be created in such a manner that its strength within that space changes with the distance from the nozzle 110. One example of such a configuration is shown in FIG. 2.

In the present example, a plurality of electrodes 121*a-d* and 131*a-d* are attached to the outer surfaces of the first and second plate electrodes 120 and 130 (i.e. on the surfaces facing away from the spray flow), respectively, in the direction parallel to the central axis A of the spray flow. Furthermore, deposition voltage suppliers 141*a-d* are individually provided between each pair of the electrodes located at the corresponding positions on the plate electrodes 120 and 130. The controller 150 regulates the magnitudes of the voltages applied to the electrodes, for example, so as to make the potential difference between the first and second plate electrodes 120 and 130 smaller on the side closer to the nozzle 110 and larger on the side farther from the nozzle 110.

Figure 2:
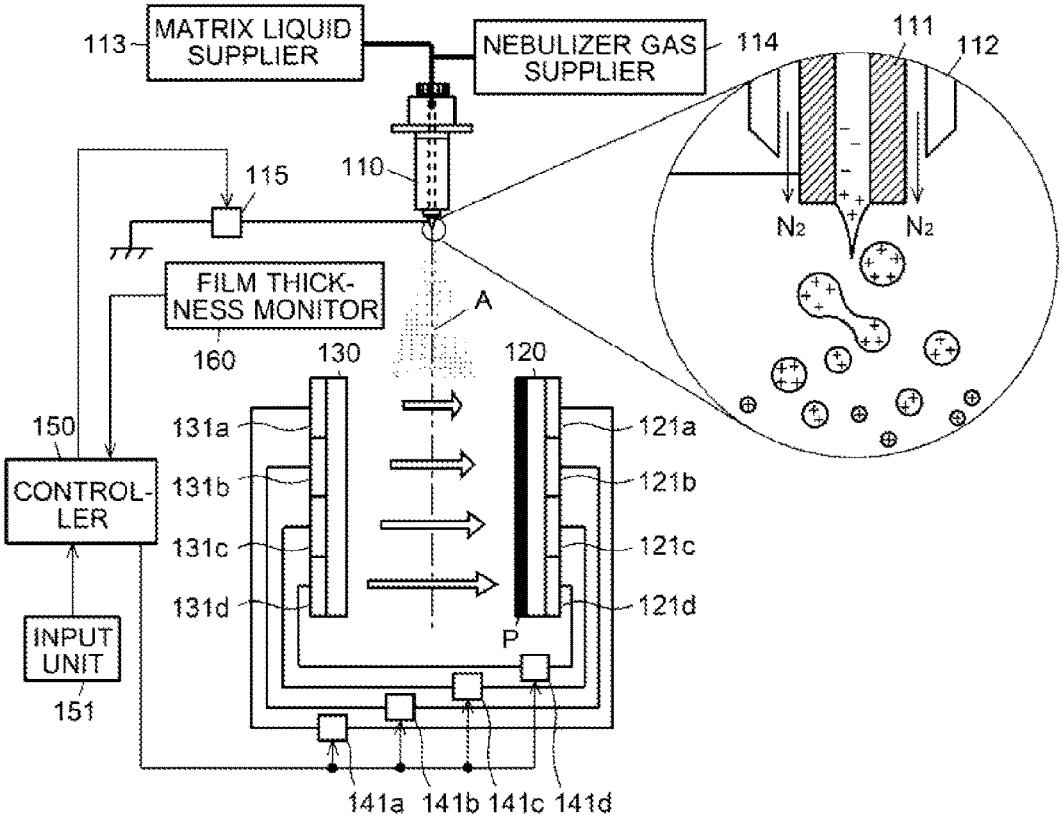
FIG. 2 is a diagram showing a modified example of the matrix film deposition system according to the first embodiment.

More specifically, in FIG. 2, the deposition voltage supplier 141*a* is provided between the electrodes 121*a* and 131*a* which are the closest pair to the nozzle, the deposition voltage supplier 141*b* is provided between the second closest pair of the electrodes 121*b* and 131*b*, the deposition voltage supplier 141*c* is provided between the third closest pair of the electrodes 121*c* and 131*c*, and the deposition voltage supplier 141*d* is provided between the electrodes 121*d* and 131*d* which are the farthest pair from the nozzle. Letting Va, Vb, Vc and Vd respectively denote the magnitudes of the voltages applied from these deposition voltage suppliers 141*a*, 141*b*, 141*c* and 141*d*, the voltage values are regulated so that Va<Vb<Vc<Vd. According to this configuration, the force acting on the electrically charged droplets ejected from the nozzle 110 to move them toward the first plate electrode 120 within the space between the first and second plate electrodes 120 and 130 is weak on the side close to the nozzle 110 and becomes stronger with an increase in the distance from the nozzle 110. This has the effect of preventing the situation in which a greater amount of matrix liquid adheres to a region close to the nozzle 110 and causes the matrix film formed on the sample plate PI to be uneven in thickness.

Alternatively, in the configuration shown in FIG. 2, the magnitude of the voltage applied between each pair of the electrodes may be controlled in the opposite way (i.e. Va>Vb>Vc>Vd) so that the potential difference between the first and second plate electrodes 120 and 130 will be larger on the side closer to the nozzle 110 and smaller on the side farther from the nozzle 110. For example, such a configuration is useful if the velocity of the spray flow from the nozzle 110 is comparatively high and the electrically charged droplets cannot easily adhere to the region close to the nozzle 110 on the sample plate P. Other voltage configurations are also possible; for example, the voltages applied along the central axis A may be controlled so that the thereby created potential difference becomes relatively larger or smaller in a region near a predetermined region (e.g. central region) of the sample plate P than in the other regions. In these examples, the electrodes 121*a-d* and 131*a-d*, the deposition voltage suppliers 141*a-d* and the controller 150 correspond to the field strength difference creator in the present invention.

In the configuration in which the field strength along the central axis A of the spray flow is varied according to the distance from the nozzle 110 in the previously described way, it is preferable to provide a film thickness monitor 160 for measuring the thickness of the matrix film at a plurality of points on the sample plate P in real time during the film deposition process, and to control the magnitude of each voltage applied from the deposition voltage suppliers 141*a-d* by a feedback process based on the film thicknesses measured at the plurality of points so that the film will have the same thickness at all the points. For example, a laser displacement sensor (displacement gauge) capable of a contactless measurement of the thickness of an object may be used as the film thickness monitor 160. In this case, laser light is cast from the laser displacement sensor onto the sample plate P and the thickness of the matrix film is determined based on the difference in the optical path length between a laser light which returns after being reflected by the surface of the matrix film and a laser light which returns after penetrating through the matrix film and being reflected by the surface of the sample plate P.

In the previously described examples, the tip of the nozzle 110 is directed downward, and the first and second plate electrodes 120 and 130 are located below the nozzle 110. The direction of the nozzle 110 as well as the position of the two plate electrodes 120 and 130 relative to the nozzle 110 in the present embodiment are not limited to those examples; the minimal requirement is that the first and second plate electrodes 120 and 130 face each other across the spray flow produced by the nozzle 110. For example, it is also possible to direct the tip of the nozzle 110 upward and place the first and second plate electrodes 120 and 130 above the nozzle 110, or to direct the tip of the nozzle 110 laterally (e.g. to the right) and place the first and second plate electrodes 120 and 130 to the right of the nozzle 110.

Second Embodiment

Figure 3:
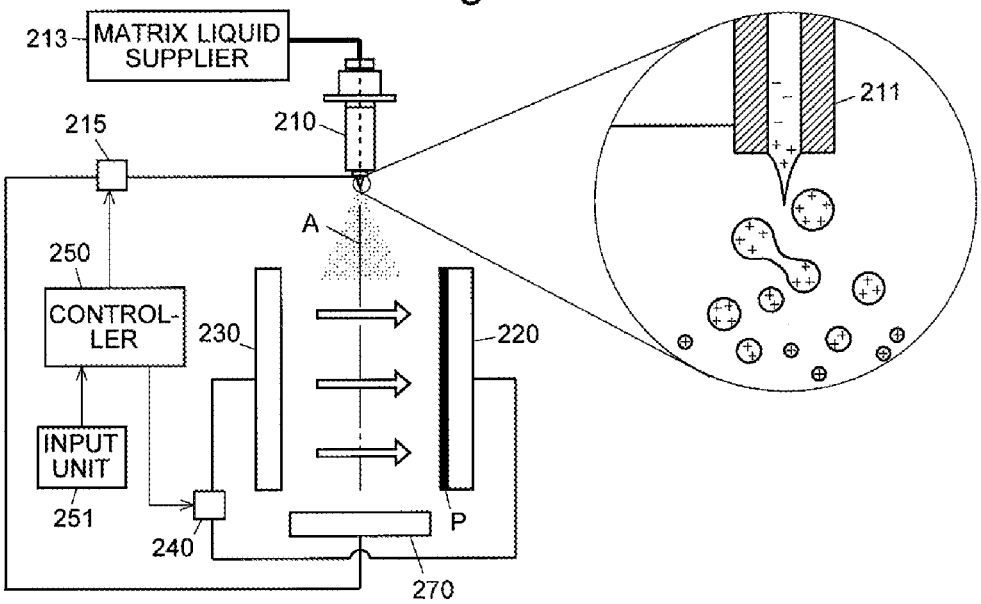
FIG. 3 is a schematic configuration diagram of a matrix film deposition system according to the second embodiment of the present invention.

A matrix film deposition system according to the second embodiment of the present invention is hereinafter described. FIG. 3 is a configuration diagram showing the main section of the matrix film deposition system according to the present embodiment. Each component which has an identical or corresponding counterpart in the already described matrix film deposition systems of the first embodiment (FIG. 1) will be denoted by a numeral whose last two digits are common to the previously described component, and its description will be appropriately omitted.

The matrix film deposition system according to the present embodiment uses the so-called "nano-electrospray" process, a kind of electrospray method, to spray the matrix liquid. In the present matrix film deposition system, the nozzle 210 is not provided with the nebulizer gas tube; alternatively, a facing electrode 270 is provided at a position facing the nozzle 210 across the space between the first and second plate electrodes 220 and 230. Furthermore, the matrix film deposition system according to the present embodiment is provided with evacuating means (not shown) including a vacuum pump and other elements below the facing electrode 270, since the spray flow from the nozzle 210 would otherwise stay within that space due to the absence of the stream of the nebulizer gas. The capillary 211 for spraying the matrix liquid is either a thin glass tube coated with a thin metallic layer or a thin metallic tube, with its tip tapered. Between the facing electrode 270 and the capillary 211, high DC voltage is applied from the spray voltage supplier 215.

In the film deposition process by the matrix film deposition system of the present embodiment, when the matrix liquid supplied from the matrix liquid supplier 213 reaches the tip of the capillary 211, the liquid becomes either positively or negatively charged (in the present example, positively) due to the influence of the electric field created by the voltage applied from the spray voltage supplier 215. This liquid, which contains a large amount of similarly charged ions, is stretched into a thin, conical shape (called the "Taylor cone") due to the effect of the electric field created in the space between the capillary 211 and the facing electrode 270 by the voltage applied from the spray voltage supplier 215. The charge density increases with the progress of the formation of the Taylor cone. When the density reaches the critical point, a Coulomb explosion occurs, whereby the electrically charged drop of the matrix liquid is broken into droplets and ejected from the tip of the capillary 211. While being progressively split into smaller sizes by the Coulomb repulsive force of the electric charges, those droplets are attracted by the facing electrode 270 and move downward. Thus, the matrix liquid is sprayed from the tip of the nozzle 210 downward. This spray flow, spreading in a roughly conical form, enters the space between the first and second plate electrodes 220 and 230. Meanwhile, DC voltage is applied between the first and second plate electrodes 220 and 230 by the deposition voltage supplier 240, with the first plate electrode 220 acting as the cathode. Therefore, the positively charged droplets of the matrix liquid which have entered the space are attracted toward the first plate electrode 220 due to the effect of the electric field created by the aforementioned voltage, and deviate from the spray flow, to eventually adhere to the surface of the sample plate P. By contrast, neutral particles (the drops without any electric charges) ejected from the tip of the capillary 211 along with the ejection of the drops of the matrix liquid are not attracted toward the first plate electrode 220; due to the gravity force combined with the operation of the evacuating means, those particles travel downward and directly pass through the space. Therefore, the neutral particles will not adhere to the sample plate P.

Thus, in the matrix film deposition system according to the present embodiment, only the electrically charged droplets of the matrix liquid are deposited on the sample plate P, so that a matrix film containing a lower amount of impurities than conventional films will be formed. Furthermore, according to a command entered by the user through the input unit 251, the controller 250 can change the magnitude of the voltage applied from the deposition voltage supplier 240 so as to limit the maximum size of the droplets of the matrix liquid to be adhered to the sample plate P (in this case, the controller 250 corresponds to the droplet size regulator in the present invention). More specifically, decreasing the magnitude of the voltage applied from the deposition voltage supplier 240 results in a smaller maximum size of the droplets of the matrix liquid to be adhered to the sample plate P.

Figure 4:
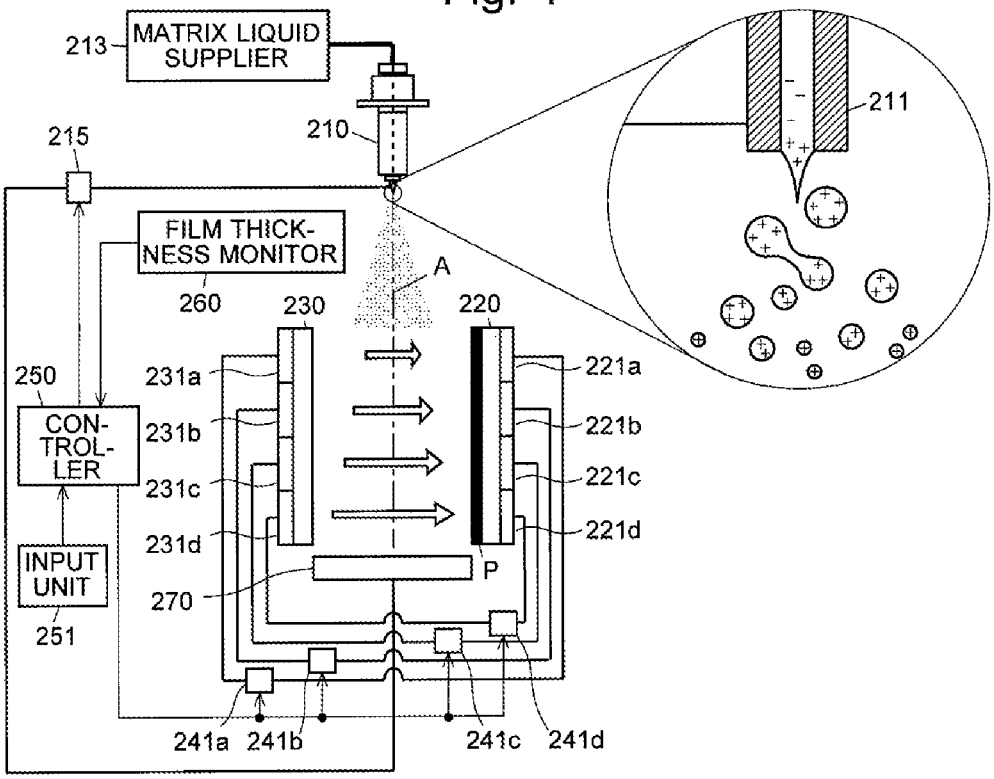
FIG. 4 is a diagram showing a modified example of the matrix film deposition system according to the second embodiment.

Similarly to the case of the first embodiment, the system according to the present embodiment may be configured so that the strength of the electric field created by voltage application from the deposition voltage supplier 240 changes with the distance from the nozzle 210 along the central axis A of the spray flow. One example of such a configuration is shown in FIG. 4.

In this example, once again, a plurality of electrodes 221*a-d* and 231*a-d* are attached to the outer surfaces of the first and second plate electrodes 220 and 230 (i.e. on the surfaces facing away from the spray flow), respectively, in the direction parallel to the central axis A of the spray flow. Furthermore, deposition voltage suppliers 241*a-d* are individually provided between each pair of the electrodes located at the corresponding positions on the plate electrodes 220 and 230. The controller 250 regulates the magnitudes of the voltages applied to these electrodes so that the potential difference between the first and second plate electrodes 220 and 230 will be smaller in a region closer to the nozzle 210 (or a region farther from the nozzle 210 or an intermediate region) and larger in the other regions. Such a voltage configuration prevents the situation in which a greater amount of matrix liquid adheres to a specific region on the sample plate P and causes the matrix film to be uneven in thickness. In the present example, the electrodes 221*a-d* and 231*a-d*, the deposition voltage suppliers 241*a-d* and the controller 250 correspond to the field strength difference creator in the present invention.

Additionally, it is preferable to provide a film thickness monitor 260 (e.g. laser displacement sensor) for measuring the thickness of the matrix film on the sample plate P in real time during the film deposition process and to control the magnitudes of each voltage applied from the deposition voltage suppliers 241*a-d* by a feedback process based on the film thicknesses measured at a plurality of points on the sample plate P by the film thickness monitor 260 so that the film will have the same thickness at all the points.

Figure 5:
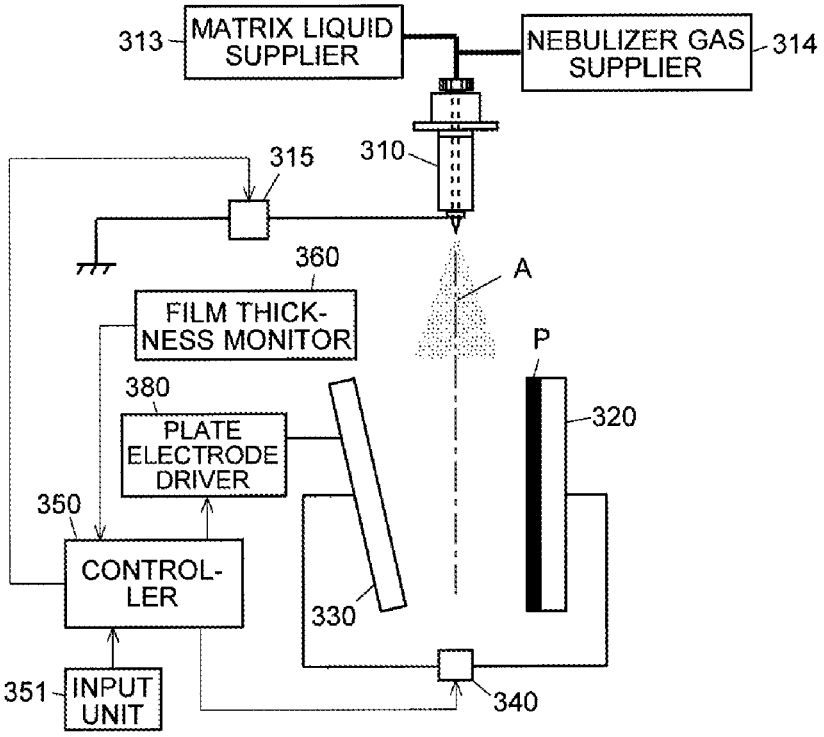
FIG. 5 is a diagram showing another example of the configuration of the matrix film deposition system according to the present invention.
Figure 6:
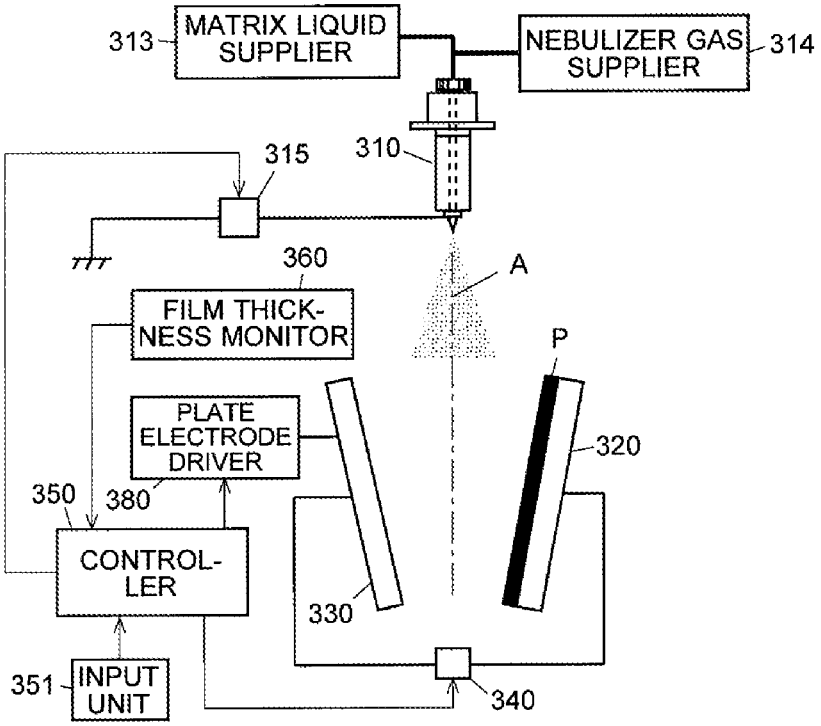
FIG. 6 is a diagram showing still another example of the configuration of the matrix film deposition system according to the present invention.

It should be noted that the present invention can be carried out in various forms and is not limited to the embodiments described thus far using specific examples. The previous embodiments can be appropriately changed within the spirit of the present invention. For example, the arrangement of the first and second plate electrodes can be changed: In the first and second embodiments, the two plate electrodes are arranged so that their respective inner surfaces (i.e. the surfaces facing the spray flow produced by the nozzle) are parallel to the central axis A of the spray flow. FIGS. 5 and 6 show different examples of the arrangement, in which one or both of the inner surfaces of the first and second electrodes 320 and 330 are inclined from the central axis A (each component which has an identical or corresponding counterpart already shown in FIGS. 1-4 is denoted by a numeral whose last two digits are common to the previously described component, and its description will be appropriately omitted).

Figure 7:
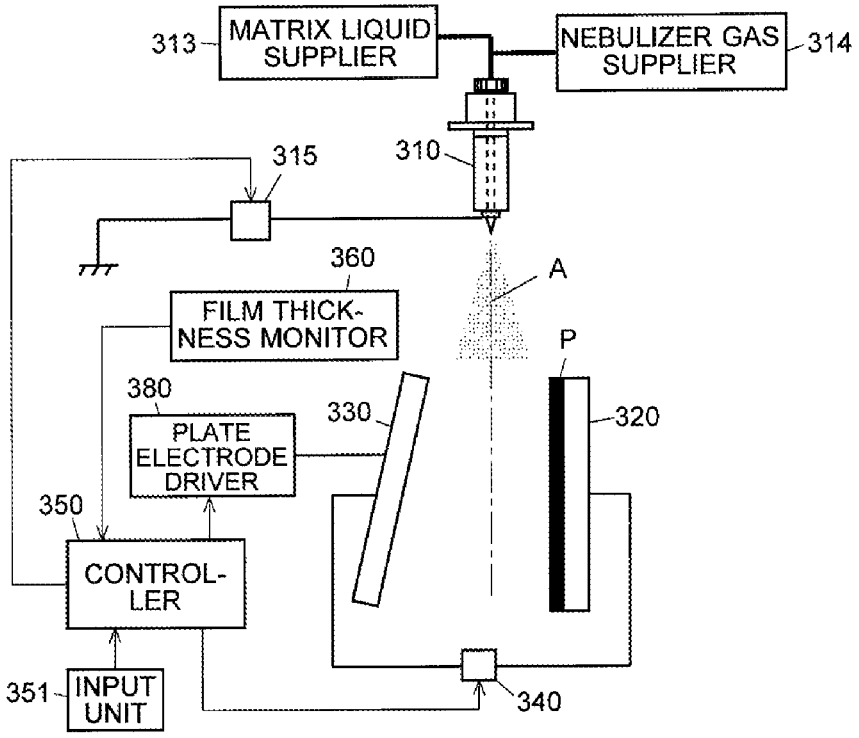
FIG. 7 is a diagram showing a modified example of the system of FIG. 5.
Figure 8:
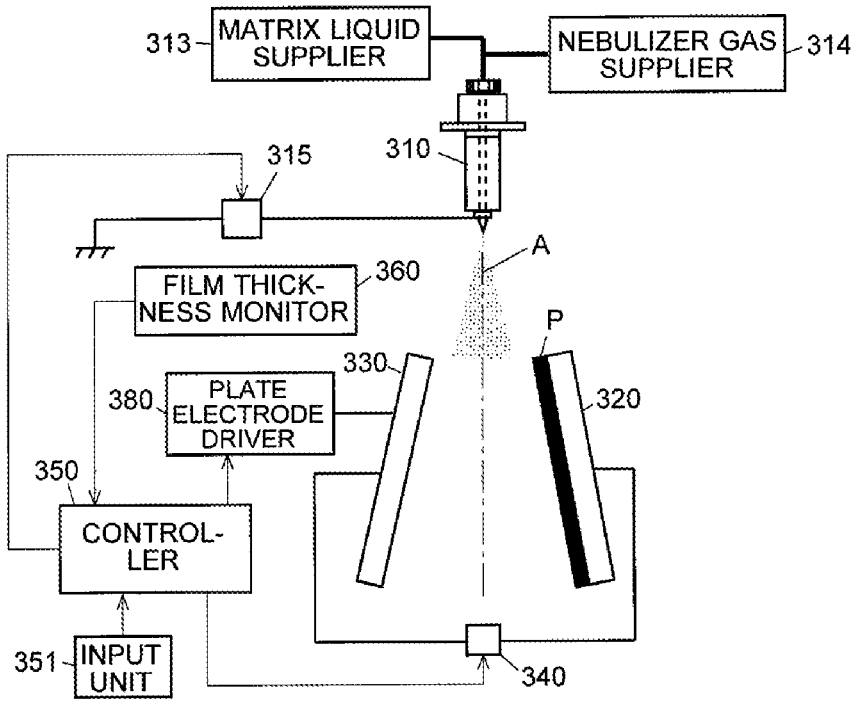
FIG. 8 is a diagram showing a modified example of the system of FIG. 6.
Figure 9:
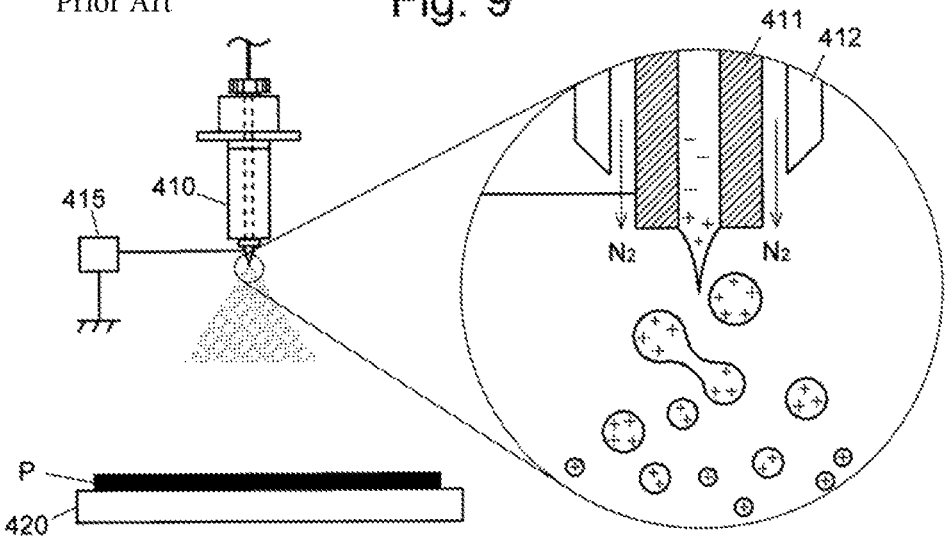
Prior Art Fig. 9
FIG. 9 is a model diagram for explaining a conventional method for depositing a matrix film on a sample plate by the ESD method.

In both FIGS. 5 and 6, the first and second plate electrodes 320 and 330 are arranged so that the distance between these two electrodes decreases with an increase in the distance from the nozzle 310. FIGS. 7 and 8 each show the opposite configuration, in which the distance between the two electrodes increases with an increase in the distance from the nozzle 310. Any of these configurations having the first plate electrode 320 and/or the second plate electrode 330 inclined from the central axis A of the spray flow is advantageous in that the potential gradient formed between the first and second plate electrodes 320 and 330 by the voltage applied from the deposition voltage supplier 340 can be varied with the distance from the nozzle 310 without providing a number of electrodes for each of the two plate electrodes 320 and 330 as in the previous embodiments. In the present examples, the first plate electrode 320 and/or the second plate electrode 330 inclined from the central axis A of the spray flow corresponds to the field strength difference creator in the present invention.

In the present configurations, it is preferable to provide a plate electrode driver 380 having a motor and other elements for changing the angle of one or both of the plate electrodes 320 and 330 as well as a film thickness monitor 360 (e.g. laser displacement sensor) for measuring the thickness of the matrix film at a plurality of points on the sample plate P in real time during the film deposition process, and to control the operation of the plate electrode driver 380 by a feedback process based on the film thicknesses measured by the film thickness monitor 360 during the deposition process so that the film will have the same thickness at all the points. In this case, the first plate electrode 320 and/or the second plate electrode 330 inclined from the central axis A of the spray flow, the plate electrode driver 380 and the controller 350 correspond to the field strength difference creator in the present invention.

REFERENCE SIGNS LIST

110, 210, 310 . . . Nozzle
111, 211 . . . Capillary
112 . . . Nebulizer Gas Tube
113, 213, 313 . . . Matrix Liquid Supplier
114, 314 . . . Nebulizer Gas Supplier
115, 215, 315 . . . Spray Voltage Supplier
120, 220, 330 . . . First Plate Electrode
130, 230, 330 . . . Second Plate Electrode
121*a-d*, 131*a-d*, 221*a-d*, 231*a-d* . . . Electrode
140, 141*a-d*, 240, 241*a-d*, 340 . . . Deposition Voltage Supplier
150, 250, 350 . . . Controller
151, 251, 351 . . . Input Unit
160, 260, 360 . . . Film Thickness Monitor
270 . . . Facing Electrode
380 . . . Plate Electrode Driver
A . . . Central Axis of Spray Flow
P . . . Sample Plate

The invention claimed is:

1. A matrix film deposition system for depositing a film containing a matrix substance on a surface of a sample plate, the system comprising:

a) a first plate electrode having an attachment surface on which the sample plate is to be attached;

b) a second plate electrode arranged so as to face the attachment surface;

c) an electrostatic spray nozzle for spraying a liquid containing a matrix substance into a space between the first plate electrode and the second plate electrode, the electrostatic spray nozzle being arranged so that neither the first plate electrode nor the second plate electrode lies on a central axis of a spray flow of the liquid;

d) an electric field creator for creating, between the first plate electrode and the second plate electrode, an electric field for forcing electrically charged droplets of the liquid containing the matrix substance contained in the spray flow to move toward the attachment surface, by applying DC voltage between the first plate electrode and the second plate electrode;

e) an electrode driver for arranging the first plate electrode and the second plate electrode so that the distance between these two electrodes decreases or increases with an increase in the distance from the electrostatic spay nozzle, wherein the nozzle includes:

f) a capillary having a tubular shape for allowing the liquid containing the matrix substance to flow from a proximal end to a droplet-spraying hole formed at a distal end, and the system further includes:

g) a facing electrode located at a position facing a tip of the nozzle; and h) a voltage supplier for applying DC voltage between the capillary and the facing electrode.

2. The matrix film deposition system according to claim 1, further comprising:

i) a droplet size regulator for regulating a size of the droplets of the liquid containing the matrix substance to be adhered to the sample plate, by changing a potential difference between the first plate electrode and the second plate electrode.

* * * * *